US005125669A

United States Patent [19]

Kanda

[11] Patent Number: 5,125,669

[45] Date of Patent: Jun. 30, 1992

[54] COURT GAME APPARATUS AND METHOD OF USING SAME

[76] Inventor: Kevin Kanda, 225½ Apolena, Balboa Island, Calif. 92662

[21] Appl. No.: 666,146

[22] Filed: Mar. 7, 1991

[51] Int. Cl.[5] ..... A63B 71/02

[52] U.S. Cl. ..... 273/411; 273/118 R

[58] Field of Search ..... 273/411, 127 A, 127 B, 273/118 R, 37

[56] References Cited

U.S. PATENT DOCUMENTS

| | | | |
|---|---|---|---|
| 269,351 | 12/1882 | Turner | 273/127 A |
| 1,644,466 | 10/1927 | Dewes | 273/37 X |
| 3,231,278 | 1/1966 | Boulanger | 273/411 X |
| 3,393,913 | 7/1968 | Safina | 273/411 X |
| 3,406,973 | 10/1968 | Poole | 273/127 B X |
| 3,451,680 | 6/1969 | Koleske | 273/118 R |
| 4,822,053 | 4/1989 | Flaherty | 273/411 |
| 4,834,392 | 5/1989 | Nixon | 273/411 |
| 4,880,243 | 11/1989 | Raub | 273/411 |
| 4,979,754 | 12/1990 | Eisenhart | 273/411 |

FOREIGN PATENT DOCUMENTS

| | | | |
|---|---|---|---|
| 599729 | 9/1948 | United Kingdom | 273/411 |

*Primary Examiner*—William H. Grieb

*Attorney, Agent, or Firm*—Bernard L. Kleinke; Jerry R. Potts; William Patrick Waters

[57] ABSTRACT

A transportable playing court, having non-ball-confining boundaries. A target ball and a plurality of server player balls and non-server player balls are provided. During play, the players attempt to throw the balls onto the court, within the boundaries thereof, such that the closest ball to the target ball, within a playing zone, scores points. A ball distance measuring device is provided for indicating the distance between a player ball and the target ball. The measuring device includes indicia for permitting a quick determination of the distance between the two balls, according to the rules of the game. According to a handicapping method, a more skilled player can be held to a higher standard of performance than a less skilled opponent, so that the opponent may score even if his or her ball is not literally closer to the target ball.

16 Claims, 2 Drawing Sheets

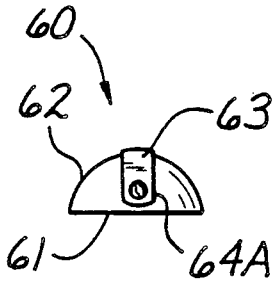
Fig. 2
Fig. 4
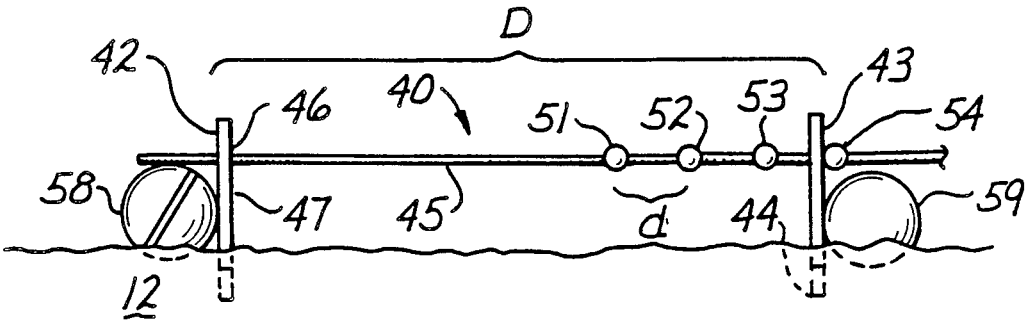
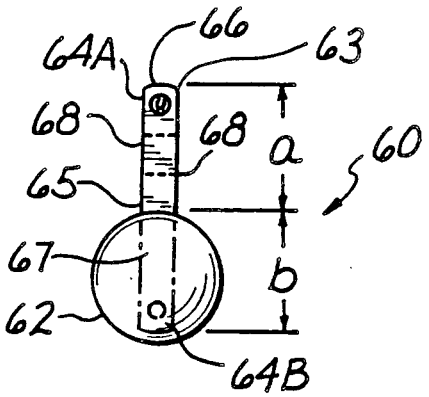
Fig. 3
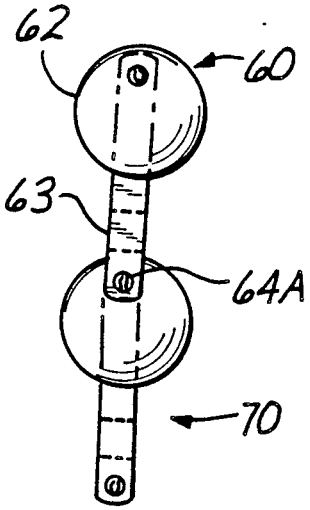
Fig. 6

COURT GAME APPARATUS AND METHOD OF USING SAME

Technical Field

The present invention relates to court games generally, and it particularly relates to a court game adapted to be played by two or more players.

Background Art

Court games, pitting individuals or teams of competitors against each other, and testing skill and coordination, are well known. Such games may be played either out of doors, or inside a structure. Handball and bowling, for example, are popular indoor recreational sports, providing opportunities for healthful exercise, and requiring some strength and skill in performance.

Facilities for such indoor games, however, are relatively expensive to build and maintain. As a result, handball courts are generally found in affluent neighborhoods where club members are financially able to support expensive facilities. Bowling alleys are, generally, commercial enterprises which players patronize on a planned, scheduled basis.

Games played outside of doors are popular. As in the case of handball and bowling, some outdoor games also require expensive facilities and costly maintenance. Examples are baseball diamonds, football fields and tennis courts. In some cases, such facilities are not always suited for wide, popular recreational use, because of their operational costs. In addition, they often require the dedication of substantial parcels of land. As a result, especially in a typical urban environment, the value of real estate sometimes discourages the dedication of significant amounts of property, for recreational use. The result is a limited availability of convenient, relatively inexpensive recreational facilities which are oftentimes patronized by people who attend as spectators of games, rather than as participants.

In view of the foregoing, it would be desirable to have a recreational or competitive game, which would not require expensive facilities and which would be readily available for people to enjoy as players, rather than as merely spectators.

Of course, less expensive outdoor recreational or competitive games have been known. Examples are horseshoes, volleyball, lawn bowling and tennis. While such games do not require the dedication of large areas of land for a playing field, it is often necessary to dedicate exclusively specified areas for their use. Lawn bowling, for example, requires a very smooth, carefully maintained grass surface. Tennis courts generally have costly surfaces, fencing and lighting. These factors sometimes limit their use, because of the initial expense, as well as the expense of maintaining the facility.

Of course, games are known which are less complicated and less expensive. In this regard, reference may be made to U.S. Pat. Nos. 269,351; 1,644,466; 3,231,278; 3,406,973; 3,451,680 and 4,834,392.

The games disclosed in the foregoing patents provide opportunities for players to compete, in a recreational manner, without spending substantial sums of money and without the necessity for dedicated facilities and expensive maintenance. However, the above-mentioned games, while generally inexpensive and thus more readily available to more people, do not readily permit competing players of widely different abilities to participate in a truly competitive manner. In the use of such games, when such different abilities exist among players, concessions to weaker players are sometimes made. The result of such concessions is often a diminishing of the competitive aspect of the game. For example, the weight of a horseshoe can make it very difficult for a younger, smaller player to throw the horseshoe with any degree of accuracy. However, if, in making a concession to the weaker player, the stakes are moved closer together, the stronger player realizes a greatly improved advantage over the opponent.

A similar situation would be experienced in volleyball, for example, if the net were lowered to accommodate a shorter player. The result, of course, would confer an inequitable benefit on the taller player. Thus, if changes are made to games, in order to adjust for differences among players, the competitive nature of the game is sometimes significantly diminished. The game quickly loses its challenge and becomes boring.

In view of these limitations, players of generally equal strength often compete only against each other, while stronger, or weaker, individuals are preempted from the game. This factor limits the utility of conventional games when, for example, people gather for recreation and fellowship at parks and beaches. In these situations, a small number of players compete in the games, while the majority of people merely observe Often in such cases, the enjoyment of a greater number of people would be realized, if many of them could play a game in a truly competitive manner.

Thus, it would be highly desirable to have a game which could accommodate variations in relative abilities, due to differences in sizes, strengths and skill levels of players, without diminishing the competitive aspects of the game. Such a game should appeal to large groups of people, especially in social settings, since players of limited ability could compete with more skilled and experienced players, in a recreational or even in a competitive manner.

Some conventional outdoor games are suitable for play by individuals of differing abilities, ages, sizes and strengths. An example of such a game is a bowling game, known as Bocci, which is adapted for use on outdoor surfaces. A version of this game is sold under the SPAULDING ® trademark. In the "open" form of such a game, a player can throw a target ball any distance, and in any direction. Points are scored for rolling or tossing another ball which comes to rest at a position closest to the target ball, as compared to all of the other balls rolled or tossed by the players.

Due to different levels of skill or abilities of the players, one player may have an unfair advantage over another. For example, if a stronger player throws the target ball a great distance, a weaker player may be placed at a great disadvantage, because he or she may be unable physically to throw accurately at such a distance. As a result, the game in this form may not be generally suitable for players of differing strengths, skill levels or abilities.

In a "closed" version of such a game, a target ball is rolled or thrown into a defined area of a court, from behind a foul line, and players compete to roll or toss balls to determine which ball comes closest to the target ball. However, in this version as well, player ability and level of skill must be matched, or else the game will not be competitive. In some cases, the court may have ball confining boundaries, such as 2×6 or 2×8 wood boards, placed on edge.

In view of the foregoing, it would also be highly desirable to rank players in a convenient manner, so that players can be readily matched for competitive play. Moreover, a player can observe his or her own growth and improvement in ability to play the game, thereby facilitating the desired growth and development. Thus, such a game should include techniques for readily and conveniently ranking players.

In view of the foregoing, it is apparent that it would be highly desirable to have a court game which could readily accommodate varying player abilities and levels of skill, without diminishing the competitive and recreational advantages of the game. Such a game should be relatively inexpensive to manufacture, and should be able to be played indoors or outdoors. When played outdoors, it should be adaptable to a wide variety of locations, including park and beach areas.

Such a game should employ techniques for constructing the court therefor in a convenient manner, for use on grassy, sandy or other surfaces. Moreover, the court should be readily transportable and able to be set up in a relatively short period of time.

Disclosure of Invention

It is the principal object of this invention to provide a new and improved court game and method of using the same in which competing players, having differing levels of skill and ability, can compete, without diminishing the competitive or recreational aspects of the game.

It is a further object of the present invention to provide a court game which provides a player ranking and handicapping method, to permit players of varying skill levels to be competitive with one another.

It is a still further object of the present invention to provide a new and improved court game which is constructed of inexpensive materials, and which is capable of being played on a variety of indoor and outdoor surfaces, such as sand or grassy surfaces and others.

It is an even still further object of the present invention to provide a new and improved court game which can be set up without the need of special tools and which is readily transportable.

Briefly, the above and further objects are realized by providing a court game, and a method of playing it, which is challenging to players having a wide variety of levels of skill and ability. The inventive game enables players to be ranked according to their abilities. The court for the game can be transported conveniently to a playing area, and can be constructed quickly and conveniently, without the need for special tools or the like.

The inventive game includes a transportable playing court, having non-ball-confining boundaries. A target ball and a plurality of server player balls and non-server player balls are provided. During play, the players attempt to throw the balls onto the court, within the boundaries thereof, such that the closest ball to the target ball, within a playing zone, scores points. A ball distance measuring device is provided for indicating the distance between a player ball and the target ball. The measuring device includes indicia for permitting a quick determination of the distance between the two balls, according to the rules of the game.

According to a handicapping method, a more skilled player can be held to a higher standard of performance than a less skilled opponent, so that the opponent may score even if his or her ball is not literally closer to the target ball.

The present invention has several advantages. In the first place, the games rules, and the adjustment characteristic of the measuring device, permit a handicapping, or player-ranking system, so that players of different skill levels are able to compete in a realistic, competitive manner. Another advantage of the present invention is that the set of rules provides numerous opportunities, throughout the game, for selecting between a more daring, potentially higher scoring style of play, and a more conservative, lower scoring style. Still another advantage of the present invention is that it is transportable, and can be moved in a convenient manner, and readily stored. An even still further advantage of the present invention is that the game rules enable competitors to play in a free flowing, extemporaneous manner, with each having a significant amount of control over game tactics and strategy. A yet further advantage is that the court can be set up quickly and easily in any suitable, convenient location, on grass or sand, without the necessity for a dedicated space, and without requiring any special tools.

BRIEF DESCRIPTION OF DRAWINGS

The above mentioned and other objects and features of this invention and the manner of attaining them will become apparent, and the invention itself will be best understood by reference to the following description of the embodiment of the invention in conjunction with the accompanying drawings, wherein:

FIG. 2 is an elevational view of a marker-distance measuring device of the game of FIG. 1;

FIG. 3 is the top plan view of the device of FIG. 2;

FIG. 4 is an enlarged elevational view of a distance measuring device;

FIG. 6 is a top plan view of the device of FIG. 2 attached to a similar device.

BEST MODE FOR CARRYING OUT THE INVENTION

Figure 1:
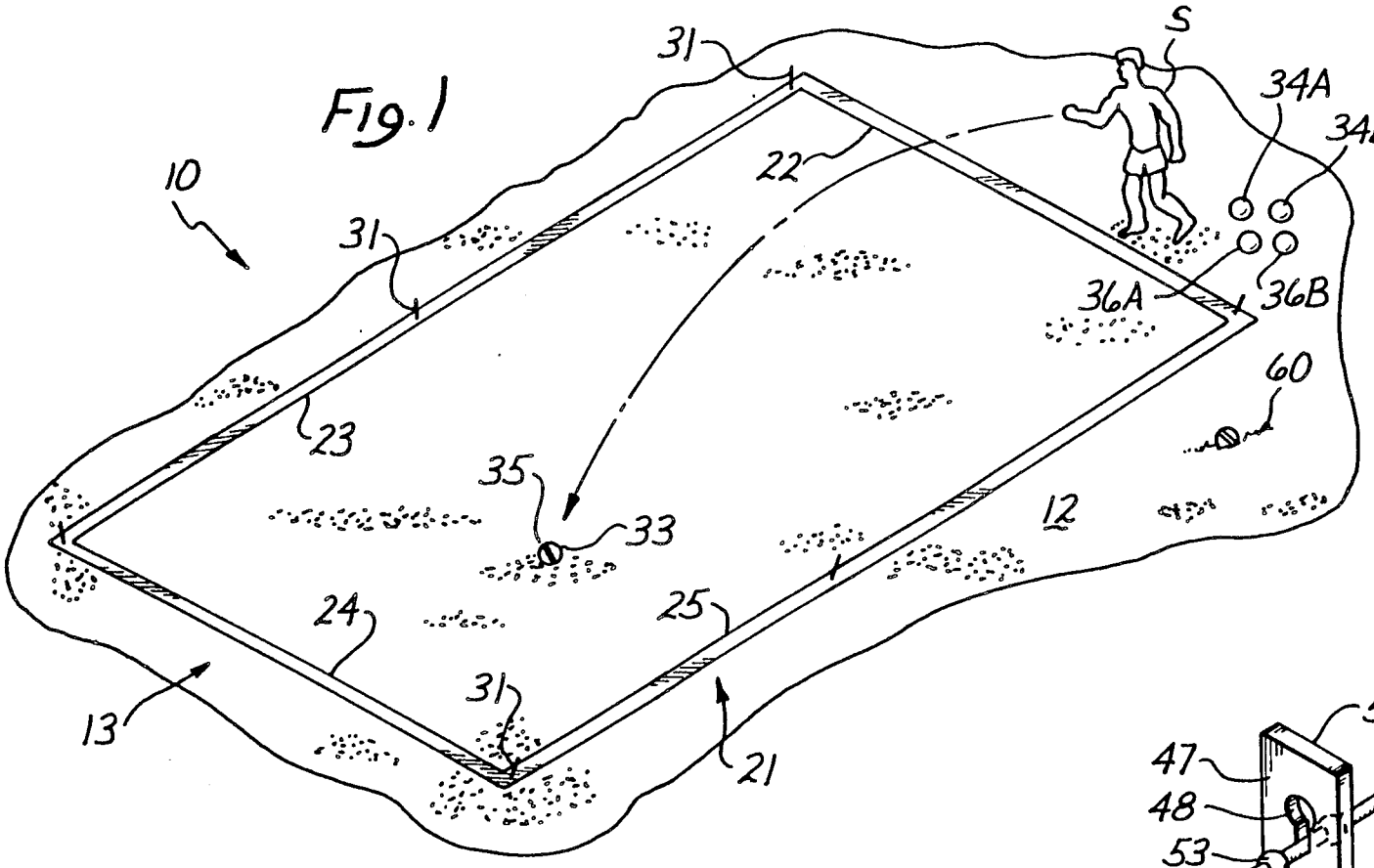
FIG. 1 is a pictorial view of the court game of the present invention.

Referring now to the drawings, and more particularly to FIG. 1 thereof, there is shown a new court game apparatus 10, which is constructed in accordance with the present invention. The apparatus 10 may be used on a number of substrates or playing surfaces 12 having a relatively flat surface, such as impacted sand, clay, asphalt and grassy surfaces.

A generally rectangular playing court 13 is defined by a boundary device 21 having right and left sidelines 23 and 25, and a pair of endlines 22 and 24.

In a preferred form of the invention, the length of the court 13, measured from the endline 22 to the endline 24, is about twice the distance between the sidelines 23 and 25. In one form of the invention, a court length is between about 20 feet and about 40 feet. A length of about 30 feet is preferred. As discussed in more detail below, the game is played over the entire surface of the court 13.

Considering now the boundary device 21 in greater detail with reference to FIG. 1, the boundary device is comprised of elongated flexible strips of cloth, plastic, rope, cord, tape or similar material, which is fixed removably to the substrate 12 by a fastening device 31, spaced at about 5 foot intervals. The fastening device 31 may be pins, spikes, nails or the like. If the substrate 12 is asphalt, wood or another hard surface, adhesive backing (not shown), or conventional tape (not shown), may be used to fix the boundary device 21 in place. The boundary device is preferably of a bright color to provide a vivid contrast with the substrate 12, having a width of about one half inch to about 4 inches. A preferred width is about one inch.

A desirable characteristic of the boundary device 21, in combination with the fastening device 31, is the ease with which the court 13 can be set up conveniently, in a selected area, without the need for any special tools. As a result, the court game apparatus 10 is suitable for use in a variety of settings, on a temporary basis, thereby obviating any need for a dedicated area.

During play, a target ball 33, server player balls 34A, 34B and non-server player balls 36A, 36B, are utilized. The target ball 33, is approximately 3 inches in diameter and is constructed of a material, such as lignum vitae, plastic, or the like, for withstanding impact against the substrate 12 and with the other balls. It is preferred that the target ball be of a distinctive color, to distinguish it from the other balls and to contrast with the substrate 12, thereby providing a visible target for the players. In addition, the target ball may be marked with any suitable indicia such as a stripe 35, to facilitate easy identification thereof.

The server player balls 34A and 34B, and the non-server player balls 36A and 36B, are slightly larger than the target ball, having a diameter of approximately $3\frac{3}{4}$ inches. These balls are similar in composition to the target ball 33. It is preferred that the server player balls, and the non-server player balls, have different colors, or bear suitable indicia, so that the balls of one team can be easily distinguished from those of the other team.

During play, a distance measuring device, such as the distance measuring device 40, and the marker-distance measuring device 60, may be used to measure the distance between the target ball 33 and one of either a server ball or a non-server ball.

Referring now to FIG. 4, there is depicted the distance-measuring device 40 interposed between a target ball 58 and a player ball 59. The measuring device 40 is comprised of a pair of stakes 42 and 43. Each stake has a pointed end, such as the end 44, to permit the stake to be inserted into the substrate 12, for distance measuring purposes. A cord 45 is fixed by a knot 46 to an eyelet (not shown) against a side 47 of the stake 42. The cord 45 has a series of discrete beads of a uniform size, such as the beads 51–54, fixed thereto at equal, predetermined intervals so that one bead is separated from another by a distance d.

Figure 5:
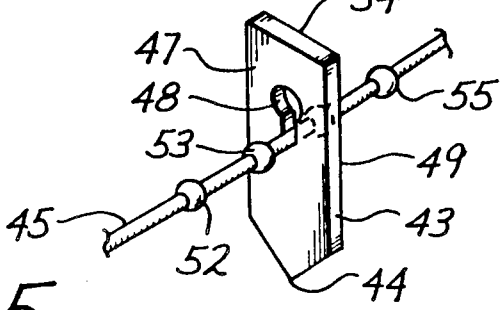
FIG. 5 is a greatly enlarged pictorial view of a portion of the distance measuring device of FIG. 4.

Considering now the distance-measuring device 40 in greater detail, with reference to FIG. 5, the stake 43 has a slot 47 having a keyhole shape. The slot 47 has an upper, round opening 48, the diameter of which is slightly larger than the diameter of the beads, such as the bead 54. Depending from the opening 48 and in open communication therewith, is a slot 49. The slot 49 has a width which is greater than the thickness of the cord 45 but less than the diameter of the bead 54. As depicted in FIG. 5, the bead 54 is held against the side of the stake 43 when the stakes 42 and 43 are pulled apart from one another, for purposes of measuring the distance D, (FIG. 4), of the player ball 59 from the target ball 58. The beads 51–54 are fixed at appropriate, regular intervals, so that for example, when bead 54 is held in place by the slot 49, the distance between the target ball 58 and the player ball 59 would be, for example, 8 inches. The beads 51–54 are located at fixed intervals, such as the interval d, along the cord 45. Thus, for example, when d equals one inch and the bead 52 is positioned against the slot 49, the distance between the target 58 and the player ball 59 is 6 inches. When the bead 51 is so positioned, the distance is 5 inches.

With further regard to the distance-measuring device 40, the stakes may be composed of wood, plastic, metal or similar material. The height of the stake is approximately 8 inches and the key slot 47 should be located on the stake 43, approximately 6 inches from the tip 44, to allow the cord 45 to clear the top of the ball 59, during distance measuring.

In general, the criteria for success at playing the game comprise the elements of suitable placement of the target ball 33 within the court 13 and by the placement of a ball, such as the server player ball 34A in proximity to it. In this regard, the distance measuring device, 40 or 60, is utilized, for indicating the position of a ball in relation to the target ball 33, in accordance with the game rules.

With reference to FIGS. 2 and 3, there is depicted a marker-distance measuring device 60 having a generally hemispherical body portion 62. The device 60 may be used as a marker to designate the position from which the server player and the non-server player make their tosses during play. In addition, the device 60 is suitable for measuring the distance between the target ball 33 and a server player or non-server player ball. The marker-distance measuring device is generally hemispherical in shape, having a flat bottom 61. A ruler 63, having distance indicating indicia 68, is attached at a hinge 65 to the body portion 62. A ruler length a is equal to a diameter b of the body portion 62. Thus, when the length of the ruler 63 is, for example, 3 inches, the marker-distance measuring device 60 can accurately measure the distance between the target ball 33 and one of the player balls to a distance of up to 6 inches. A snap fastener 66 on the ruler 63 engages a fastener receiver 64B on the body portion 62 so that when the device 60 is not being used for distance measuring purposes, the ruler 63 may be rotated about the hinge 65 in such a manner that the snap fastener 64A engages the fastener receiver 64B, to hold the ruler 63 securely in place. In this regard, a trough 67 in the body portion 62 accepts the ruler 63, thereby imparting a generally smooth surface to the device 60 when the ruler is in the closed condition. The ruler 63 has a rounded end 66 conforming with the radius of the body portion 62.

The ruler 63 may be comprised of any suitable, nonelastic material, and when the device 60 is not in use, the device may be fixed conveniently to a belt or a bathing suit strap by engaging the fastener 64A to the receiver 64B. In some applications, when the game rules permit, the marker-measuring device 60 may be fastened, to device 70, thereby permitting the measurement of distances greater than those which could be measured by the device 60 alone. In these cases, the snap fastener 64A engages an appropriate receptacle portion, not shown, on the device 70.

The rules discussed herein relate to a game involving two individuals, a server player and a non-server player, each having a pair of balls, 34A, 34B and 36A, 36B, respectively. However, the game is not limited to two players, and may be played by more than two players, or by teams of players. In this event, the number of balls utilized during play will be increased.

The terms "server player" and "non-server player", as used herein, may apply to both competitors at different times during play. Thus, after one competitor wins the right to go forward as the server player S, the other becomes the "non-server player". If a server player S faults and the serve goes over, the roles and identities of the competitors are reversed, and the erstwhile non-server player becomes the server player S.

In a preferred method of playing the game, points are scored only by the server player. To score, the server player S must successfully perform two tasks. First, he or she must toss the target ball 33 so that it comes to rest within boundaries of the court 13. The server player S must then throw a second ball, 34A or 34B, so that it comes to rest at a location, within the court 13, closer to the target ball 33 than either of the non-server player balls 36A or 36B, thrown by the competitor.

The serve goes over when the non-server player places his or her ball, 36A or 36B, within the court 13 and closer to the target ball 33 than a ball, 34A or 34B, thrown by the server player S.

A suitable set of rules for using the game of the present invention, will now be described.

A server player S is identified. Each player takes a position along a sideline, tosses a ball, other than the marker ball 33, over one of the sidelines and into the court 13, in an attempt to get as close as possible to, or touching, the other sideline, without having the ball go beyond the sideline and landing out of bounds. The player whose ball comes to rest closer to the sideline, within the court 13, becomes the server player S. Only the server player S scores points during play.

Play commences when the server player S tosses the marker ball 33 in an attempt to have it come to rest within the court 13. The target ball 33 may be tossed from any convenient location, either in bounds, or from a location outside the boundaries of the court 13. For a successful toss, the target ball 33 must be thrown so that it comes to rest within the court 13, and at least five feet from the location of the server player S. The ball may be thrown in any comfortable manner, as elected by the server player S. If the target ball 33 comes to rest outside the court 13, or if the target ball comes to rest at a distance of less then five feet from the server player S, a fault is declared and the serve goes over to the opponent, who then becomes the server player S.

After a successful toss by the server player S, subsequent tosses, by either the server player S, or by the nonserver player, are made from the spot where the server player S originally tossed the target ball 33. As an aid in identifying the location of this spot, the marker-distance measuring device 60 may be utilized. The device 60 may be a round plastic, or rubber, device having a diameter of about three to about four inches, which is placed on the substrate 12, either within the court 13, or outside the court, to mark the spot from which the server S tossed the marker ball 33.

The server player throws the server player ball 34A from the spot located by the marker-distance measuring device 60. The nonserver player throws the nonserver player ball 36A from the spot located by the device 60. The server player then throws ball 34B and the nonserver player thereafter throws ball 36B. If either ball 34A or 34B knocks the target ball 33 out of the court 13, a fault is declared and the serve goes over to the opponent. If, on the other hand, a nonserver ball, either 36A, or 36B, knocks the target ball 33 out of the court 13, and the nonserver ball remains within the court 13, a fault is declared and the serve goes over to the opponent. If, in this case, the nonserver ball does not come to rest within the court 13, no fault is declared and the server player S retains the serve.

After all the server player balls, and the nonserver player balls, have been tossed, play is stopped and a determination is made if a point is to be scored.

A point is scored if one of the server player balls, either 34A or 34B, is within a predetermined distance from the target ball 33, and is closer to the target ball 33 than either one of the non-server player balls 36A or 36B. Alternatively, a point is scored if both nonserver player balls, 36A and 36B, come to rest out of bounds. In the event one of the non-server player balls 36A or 36B comes to rest closer to the target ball 33 than one of the server player balls 34A or 34B, no points are scored and the serve goes over to the opponent. The nonserver player then becomes the server player S, and play commences as described above.

Only the server player can score a point. The game is over when a player reaches 15 points and leads the opponent by a minimum of 2 points. In the event there is not a two point spread, play continues until one opponent has more than 15 points, and leads the other by 2 points.

An advantage of the present invention is that, by prior agreement between the players, the scoring system may be altered and a handicapping method may be utilized. In this manner, players can be ranked so that similarly ranked players can play against each other on an equal basis, while players with different skill levels can compete in a meaningful way because of the handicapping capability. Thus, for example, a highly skilled player, in the role of the server player S, may be required to place a server player ball, 34A or 34B, within a shorter, predetermined, distance from the target ball 33 than would be required for a less skilled server player. Thus, for example, the highly skilled server player could be entitled to score only when his or her ball comes to rest within 6 inches of the target ball 33, while a less skilled server player could score when his or her ball comes to rest within 10 inches of the target ball.

In view of the above, the term "closer", as employed herein, may be used in either a literal, or artificial, sense. Thus, when equally matched players compete, only the actual distance of the player balls, from the target ball, is considered. On the other hand, when players of unequal skill or experience levels compete, the term "closer" may be used in an artificial sense. In this case, by agreement between the competitors prior to commencement of play, the less skilled player may be permitted to have his or her ball designated as "closer", even though, literally, it is farther away from the target ball. In this regard the distance measuring device has significant utility.

To illustrate the handicapping method as it may be applied according to the game rules, it may be assumed that a server player has a 0 handicap while the opponent, nonserver player has a handicap of 4. With the server player ball designated as Ball 1 and the nonserver player ball as Ball 2, the results of three different game situations can be tabulated as follows:

TABLE 1

| BALL 1 Distance from target (inches) | BALL 2 Distance from target (inches) | RESULT |
|---|---|---|
| 1 | 5 | No points, no fault, play is resumed |
| 1 | 4 | Fault declared, serve goes over to non-server player |
| 2 | 7 | Point scored by server player |

A further advantage of the present invention is that the scoring system is adjustable to provide the players numerous opportunities during play to elect a more daring, higher scoring play, as opposed to a more conservative style. The risk of a fault, and loss of turn, increases the closer to one of the non-ball confining boundaries the server player S attempts to place the target ball 33. Thus, if the server player S is successful in placing the ball 33 on one of the boundaries, yet within the court 13, the player can be rewarded with an additional point, if subsequently, the server ball is closer than a ball of the opponent. Thus, when the target ball 33 comes to rest within the court 13 and touching either one of the sidelines 23 and 25, or the endline 24, a successful score would be rewarded with 2 points.

Thus, the rules of the game not only provide a means for rewarding skillful play, they also provide an incentive for a losing player, for example, to make riskier tosses of the target ball 33, in an attempt to capture the lead. Thus, considerable flexibility exists throughout the game, and numerous choices are available to the players, with regard to the choice of conservative, as opposed to more aggressive, styles of play.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A court game in which players compete by attempting to place a player ball closer to a target ball, comprising:

court boundary means defining a playing court;

a target ball;

a plurality of player balls;

player handicapping means for ranking players according to the relative skill of the players to enable a lesser skilled player to compete with a more skilled player by scoring a point or declaring a default when the player ball of said lesser skilled player comes to rest farther from the target ball than the player ball of said more skilled player, in accordance with game rules, said handicapping means including target ball means for designating the position of said target ball within said playing court, to provide a point of reference for the target ball in accordance with the game rules, player ball means for designating the position of a player ball within said playing court, to provide a point of reference for one of said player balls in accordance with the game rules, measuring means including distance indicating means for displaying the distance between said target ball means and said player ball means, in accordance with the game rules, said measuring means including a plurality of indicia means for displaying said distance, wherein a point is scored if a player ball, within the playing court, is positioned within a predetermined distance from said target ball wherein said measuring means include connecting means, said connecting means being disposed between said target ball means and said player ball means, said measuring means including said indicia means wherein one of said indicia means corresponds to one of said players and one other of said indicia means corresponds to one other of said players for defining a different distance from the target ball for determining a scoring possibility in accordance with the game rules, said indicia means being fixed to said connecting means at predetermined intervals to enable a ready determination of the distance between the target ball and the player ball, said measuring means also including means for receiving said indicia means and means for engaging reversibly said indicia means to permit adjustment to predetermined lengths of the measuring means.

2. A court game of claim 1 wherein said measuring means includes a pair of stakes having connecting means interposed therebetween, said means being fixed to one stake and attached reversibly to the other stake.

3. A court game of claim 2 wherein said measuring means includes a body portion having a ruler hingedly attached thereto.

4. A court game of claim 2, wherein said connecting means is a cord.

5. A court game of claim 4 wherein said indicating means includes a plurality of discrete, substantially uniformly sized beads.

6. A court game of claim 1 wherein said receiving means is larger than said indicating means for permitting passage of said indicating means therethrough, and said engaging means is smaller than said indicating means.

7. A court game of claim 1 wherein said boundary means are non-ball-confining to permit said target ball, or any one of said player balls, to move unimpeded thereacross.

8. A court game of claim 1 wherein said boundary means is selected from the group consisting of ribbon, tape, rope and cord.

9. A court game of claim 1 further including fastening means for removably fixing said boundary means to a surface to define a forecourt and a playing zone.

10. A court game of claim 9 wherein said fastening means includes pins.

11. A method of playing a court game comprising:

designating a court having boundary lines;

designating a server player;

designating a non-server player;

using a target ball;

using a plurality of server player balls and a plurality of non-server player balls;

using a measuring device having a plurality of indica means thereon;

designating one of said indicia means as a server player indicia means for ranking players according to the relative skill of the players to enable a lesser skilled player to compete with a more skilled player by scoring a point when the player ball of said lesser skilled player comes to rest farther from the target ball than the player ball of said more skilled player, in accordance with game rules, thereby providing handicapping means to enable a lesser skilled player to compete with a more skilled player;

designating another one of said indicia means as a non-server player indica means for ranking players according to the relative skill of the players to enable a lesser skilled player to compete with a more skilled player by having a default declared when the player ball of said lesser skilled player comes to rest farther from the target ball than the player ball of said more skilled player, in accordance with game rules, thereby providing handicapping means to enable a lesser skilled player to compete with a more skilled player;

tossing the target ball by the server player at least a minimum predetermined distance within the court in accordance with the game rules;

tossing a server player ball by a server player into said court in an attempt to place said ball as close as possible, within said court, to said target ball;

tossing a non-server ball by a non-server player into said court in an attempt to place said ball, within said court, closer to said target ball than the ball thrown by said server player;

marking the position of the target ball;

marking the positions of the server player ball and of the non-server player ball;

determining the distance of the server player ball and the non-server player ball from said target ball;

scoring a point for the server player if the server player ball is closer to the target ball than the non-server player ball according to the handicapping system;

determining the distance between the tossed target ball and the tossed server player ball to establish the awarding of a point when the tossed server player ball is closer to the target ball than a non-server player ball and said server player ball is within such distance according to the game rules;

determining the distance between the tossed target ball and the tossed non-server ball to establish the awarding of the server to the non-server player when the tossed non-server player ball is closer to the target ball than a server player ball according to the game rules;

using a handicapping system to determine a scoring possibility for players having dissimilar playing skills, wherein the players are ranked according to the relative skill of the players to enable a lesser skilled player to compete with a more skilled player by scoring a point when the player ball of said lesser skilled player comes to rest farther from the target ball than the player ball of said more skilled player, in accordance with game rules; and declaring a fault if the non-server player ball is closer to the target ball than the server player ball.

12. A method of claim 11 including scoring an additional point when the target ball, within the playing court, engages a boundary line and a server player ball, within the playing court, is closer than another ball to said target ball, within the playing court.

13. A method of claim 11 further including determining a handicapping system of play whereby a player is entitled to score a point when said player is designated a server player, or to have a fault declared when said player is designated a non-server player, when a player ball tossed by said player is measured at a greater distance from said target ball than the distance of another ball.

14. A method of claim 11 including designating said playing court by a pair of endlines and a pair of sidelines.

15. A method of claim 11, including declaring a fault when said player server fails to toss said target ball at least five feet, so that said target ball comes to rest within said court.

16. A method of claim 11, including declaring a fault when said non-server player ball, while remaining in bounds, knocks said target ball out of bounds.

* * * * *